US011946692B2

(12) United States Patent
Terrien et al.

(10) Patent No.: US 11,946,692 B2
(45) Date of Patent: Apr. 2, 2024

(54) METHOD FOR SEPARATING A MIXTURE CONTAINING AT LEAST NITROGEN AND METHANE

(71) Applicant: L'Air Liquide Société Anonyme pour l'Etude et l'Exploitation des Procédés Georges Claude, Paris (FR)

(72) Inventors: Paul Terrien, Syracuse, NY (US); Nicolas Chantant, Grenoble (FR); Jean-Marc Peyron, Creteil (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 56 days.

(21) Appl. No.: 17/716,801

(22) Filed: Apr. 8, 2022

(65) Prior Publication Data

US 2022/0325951 A1 Oct. 13, 2022

(30) Foreign Application Priority Data

Apr. 9, 2021 (FR) ..... 2103659

(51) Int. Cl.
*F25J 3/02* (2006.01)

(52) U.S. Cl.
CPC ..... *F25J 3/0233* (2013.01); *F25J 3/0257* (2013.01); *F25J 3/0295* (2013.01); *F25J 2200/06* (2013.01); *F25J 2200/74* (2013.01); *F25J 2290/12* (2013.01)

(58) Field of Classification Search
CPC ..... F25J 3/0233; F25J 3/0257; F25J 3/0295; F25J 2200/06; F25J 2200/74; F25J 2290/12
See application file for complete search history.

(56) References Cited

U.S. PATENT DOCUMENTS

| | | | |
|---|---|---|---|
| 6,128,920 | A | 10/2000 | Matsuo et al. |
| 6,349,566 | B1 | 2/2002 | Howard et al. |
| 10,006,699 | B2 | 6/2018 | Briglia et al. |
| 2012/0090355 | A1 | 4/2012 | Johnson et al. |

FOREIGN PATENT DOCUMENTS

| | | |
|---|---|---|
| JP | H10 197169 | 7/1998 |

OTHER PUBLICATIONS

Pruitt, C.A. et al., Wyoming's Shute Creek plant uses NRU unit, Oil and Gas Journal, Pennwell, Houston, TX US, vol. 87, No. 41, Jan. 1, 1989, 78-82.

French Search Report for corresponding 2103659, dated Dec. 21, 2021.

*Primary Examiner* — Nael N Babaa
(74) *Attorney, Agent, or Firm* — Elwood L. Haynes

(57) ABSTRACT

A method for separating a mixture containing at least nitrogen and methane by cryogenic distillation in a first column operating in a first pressure and a second column operating at a second pressure lower than the first pressure, the mixture being separated in the first column to form a gas enriched in nitrogen and a liquid enriched in methane, at least a portion of the gas enriched in nitrogen being at least partially condensed in a heat exchanger and returned to the first column, the gas enriched in nitrogen is sent into the heat exchanger by the bottom, ascends in a first series of passages of the exchanger and condenses therein at least partially, the liquid formed descending in these passages of the first series and exiting by the bottom of the exchanger.

12 Claims, 2 Drawing Sheets

METHOD FOR SEPARATING A MIXTURE CONTAINING AT LEAST NITROGEN AND METHANE

CROSS REFERENCE TO RELATED APPLICATIONS

This application claims the benefit of priority under 35 U.S.C. § 119 (a) and (b) to French Patent Application No. 2103659, filed Apr. 9, 2021, the entire contents of which are incorporated herein by reference.

BACKGROUND

The present invention relates to a method for separating a mixture containing at least nitrogen and methane by cryogenic distillation.

The mixture preferably comprises nitrogen and/or methane as the main component or main components.

Crude natural gas may contain a large number of troublesome impurities to be removed. Nitrogen is an example of said impurities. Above a certain concentration of nitrogen in natural gas, said gas typically cannot be sold, on account of its low calorific power. To remove the nitrogen, it is usual to use a cryogenic process referred to as a nitrogen rejection unit (NRU).

FIG. 1 shows a very effective scheme for separating the nitrogen and the methane for this cryogenic process when these components are in proportions which are close to one another, this scheme being the double column scheme. In this scheme, the pressures of a first column K1 operating at a first pressure and of a second column K2 operating at a second pressure, lower than the first pressure, are selected so as to allow the condensation function of the first column K1 to be combined with the reboiling function of the column K2. The fluids condensed and reboiled are usually impure.

The feed gas 1 is a mixture of nitrogen and methane, preferably having these components as the main components. The gas 1 is cooled in the heat exchanger E1 and expanded in a valve V1 and is sent to the first column K1. It separates there into a gas enriched in nitrogen 5, at the top of the column, and a liquid 3 enriched in methane, at the bottom of the column. The liquid 3 may be sent elsewhere or else subcooled in a heat exchanger E2 and sent, after expansion in a valve V2, to the second column K2 at an intermediate level.

The gas 5 is condensed (at least partially) in an evaporator-condenser E3 and the condensed gas 9 is sent to the top of the column K1 to serve for reflux.

The remainder of the condensed gas 11 is subcooled in the exchanger E2 and sent to the top of the column K2 after expansion in the valve V3. The bottom liquid 13 from the second column K2 evaporates at least partially in the evaporator-condenser E3 and is returned as gas 17 to the bottom of the column K2.

Liquid rich in methane 14 is withdrawn from the bottom of the column K1, pressurized in a pump P, reheated in the exchanger E2, and evaporated and reheated in the exchanger E1. A gas 21 rich in nitrogen is withdrawn at the top of the column K2 and undergoes reheating in the exchangers E2, E1.

A conventional solution for the evaporator-condenser E3 is to use an exchanger in the form of a bath evaporator. The problem is that the exchange requires substantial recirculation of the liquid arriving in effect at a bath temperature which is higher for an equivalent purity of the methane product. FIG. 2 shows the exchange diagram, with the enthalpy H on the x-axis and the temperature Ton the y-axis. Since this exchange is not optimized, the difference in pressure between the columns K1 and K2 must be increased. This problem is specifically linked to this type of process, since it arises solely in the case where the condensation curve (left-hand line) in (FIG. 2) and evaporization curve (right-hand line), without recirculation, exhibit a substantial variation in temperature (typically more than 2° C., preferably more than 5° C.). Owing to the recirculation, the evaporation temperature is virtually constant and hence in the example of FIG. 2 the temperature of the hot end of E3 is −155° C. and the cold end is limited to −156° C. In addition to this, with an approach typical for this type of exchanger (~2° C.), the condensation temperature at the cold end is limited in this example to around −154° C.

In order to overcome this problem, it must be possible to perform a true counter-current exchange without recirculation.

SUMMARY

According to the invention, to solve the problem associated with the evaporation of the impure bottom liquid, the proposal made is to use a film-evaporator technology for the exchanger E3 of FIG. 3 in a scheme such as FIG. 1. The exchanger E3 consists of a stack of plates separated by fins, with the whole being brazed together. The stack comprises two series of vertical passages, one series dedicated to the condensation of a gas and the other series dedicated to the partial evaporation of a liquid. The passages alternate such that each passage dedicated to partial evaporation is adjacent to two passages dedicated to condensation, and each passage dedicated to condensation is adjacent to two passages dedicated to partial evaporation, with the exception of the edge passages.

US10006699 and US2012/090355 describe a method according to the known art.

According to one subject of the invention, a method is provided for separating a mixture containing at least nitrogen and methane by cryogenic distillation in a system of columns comprising a first column operating in a first pressure and a second column operating at a second pressure lower than the first pressure, the mixture being separated in the first column to form a gas enriched in nitrogen and a liquid enriched in methane, at least a portion of the gas enriched in nitrogen being at least partially condensed in a heat exchanger and returned to the first column, the liquid enriched in nitrogen being sent from the exchanger or from the first column to the second column, a liquid rich in methane being withdrawn at the bottom of the second column and a gas rich in nitrogen being withdrawn at the top of the second column, the heat exchanger consisting of a stack of plates and fins, the plates being disposed with their axis vertically and the space between the plates forming vertical passages, characterized in that the gas enriched in nitrogen is sent into the heat exchanger by the bottom, ascends in a first series of passages of the exchanger and condenses therein at least partially, the liquid formed descending in these passages of the first series and exiting via the bottom of the exchanger, the liquid descending in the second column being distributed to descend in another series of passages of the exchanger, where it evaporates partially to form a biphasic mixture which is collected at the bottom of the exchanger.

According to other, optional aspects:

- the mixture contains at least nitrogen and methane as main components.

non-condensable gases are extracted at least periodically from the first series of passages.

the condensed gas enriched in nitrogen is sent to the top of the first column, the condensed gas enriched in nitrogen is sent to the top of the first column via two or more conduits connecting the exchanger to the top of the first column.

the liquid descending in the second column arrives in the exchanger at between −160° C. and −164° C., preferably at −162° C.

the liquid descending in the second column arrives in the exchanger at a temperature T1 and emerges therefrom at a temperature T2, with T2>T1+2° C., preferably T2>T1+3° C. the liquid descending in the second column exits from the first series of passages, where it evaporates partially at between −153° C. and −157° C., preferably at −155° C.

the gas ascending from the first column arrives in the exchanger at a temperature T3 and emerges therefrom at a temperature T4, with T3>T4+2° C., preferably T3>T4+3° C.

T4−T1<1.5° C.

the gas ascending from the first column to the first series of passages of the exchanger exchanges material with the liquid formed descending in these passages.

a distillation step is carried out in the passages of the first series.

at least a portion of the liquid enriched in methane is sent from the first column to the second column.

no portion of the liquid enriched in methane is sent from the first column to the second column.

the liquid for evaporation falling directly from the lowest heat and mass exchange section of the second column is not sent to the first series of passages.

the gas for condensing NG enriched in nitrogen from the top of the first column is not introduced into the second series of passages of the exchanger.

the percentage of nitrogen in the mixture differs from the percentage of methane in the mixture by at most 20%, or even at most 10%.

the heat exchanger is a film evaporator.

According to another subject of the invention, an apparatus is provided for separating a mixture containing at least nitrogen and methane by cryogenic distillation in a column system comprising a first column operating at a first pressure and a second column operating at a second pressure lower than the first pressure, means for sending the mixture to separate in the first column to form a gas enriched in nitrogen and a liquid enriched in methane, a heat exchanger, means for sending at least a portion of the gas enriched in nitrogen to condense at least partially in the heat exchanger, means for sending at least the liquid enriched in nitrogen from the first column or the heat exchanger to the second column, means for returning the condensed gas enriched in nitrogen to the first column, means for withdrawing a liquid rich in methane from the bottom of the second column, means for withdrawing a gas rich in nitrogen from the top of the second column, the heat exchanger consisting of a stack of plates and fins, the plates being disposed with their axis vertically and the space between the plates forming vertical passages, characterized in that the means for sending at least a portion of the gas enriched in nitrogen to condense at least partially in the heat exchanger and the means for returning the condensed gas enriched in nitrogen to the first column are connected to the lower ends of a series of passages of the heat exchanger, the apparatus comprising means for sending the liquid descending in the second column to the upper ends of another series of passages of the exchanger, and means for collecting a biphasic mixture formed by the partial condensation of the liquid descending in the column below the exchanger.

The heat exchanger may be disposed at the bottom of the second column or inside a chamber disposed in the second column or below the second column, the base of the chamber serving for collection of the biphasic mixture.

In this case the liquid is evaporated on circulating from the top to the bottom in the heat exchanger in a series of passages, and to create a counter-current, it is necessary in that case to condense the gas towards the top. This is not possible with conventional passages in which the gas and the liquid exit in the opposite direction from the feed, since the pressure drop must be able to compensate the gravitational force.

In this case several bars of pressure drop are typically required, which is not realistic.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DETAILED DESCRIPTION OF PREFERRED EMBODIMENTS

One solution is to condense the gas enriched in nitrogen ascending in the other series of passages, but deliberately to allow the liquid to descend again and to collect it at the bottom of the heat exchanger. The system is a dephlegmator system. The gas ascending from the first column to the first series of passages of the exchanger exchanges material with the liquid formed descending in these passages, for example via a distillation step carried out in the passages of the first series.

Figure 1:
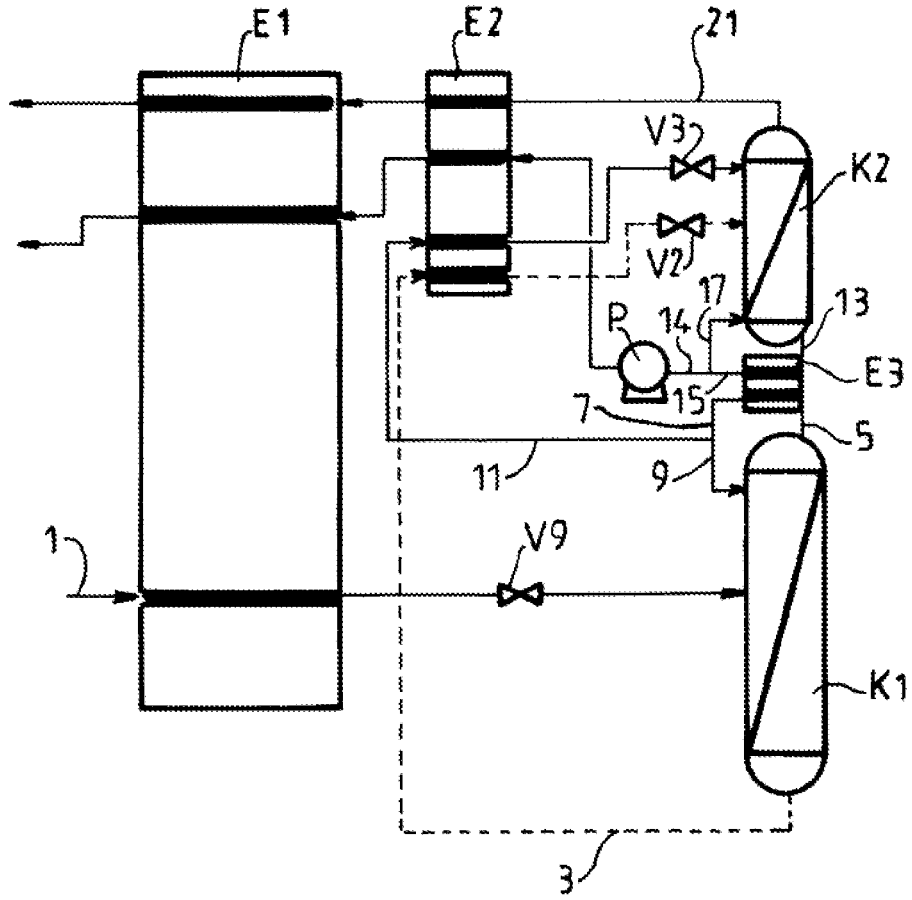
FIG. 1 is a schematic representation of system for separating nitrogen from natural gas as is known in the art.
Figure 2:
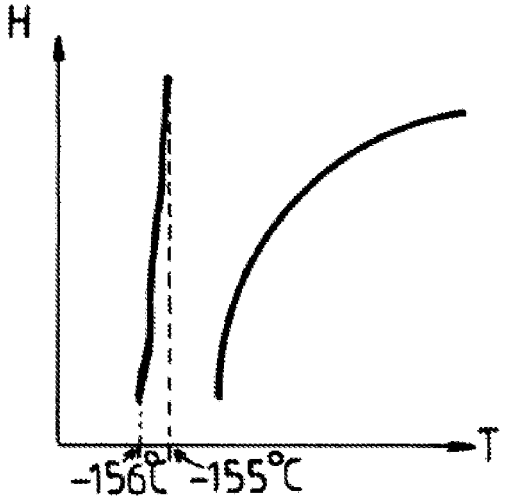
FIG. 2 is a H-T diagram illustrating an exchange using an exchanger known in the art.
Figure 3:
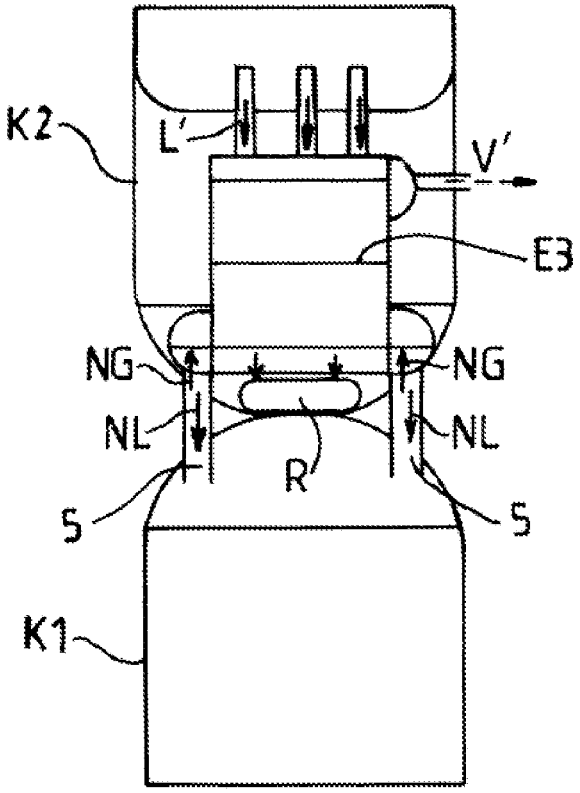
FIG. 3 illustrates part of a separating apparatus according to one embodiment of the present invention.

The liquid enriched in methane is, moreover, partially evaporated in direct contact with this hotter gas resulting from the evaporation of the liquid enriched in methane, so giving rise to the beneficial effect of distillation (which enables a reduction in the height of the column K1 for equivalent performance levels). FIG. 3 illustrates the exchanger required, which is a film evaporator-dephlegmator.

Figure 4:
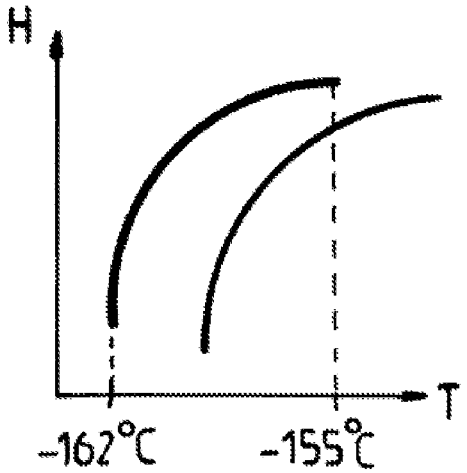
FIG. 4 illustrates the change in enthalpy H with temperature for the evaporator of FIG. 3.

This technology makes it possible to obtain a counter-current heat exchange with a beneficial distillation effect and a very low level of proximity between hot fluid and cold fluid. FIG. 4 illustrates the exchange diagram for the evaporator E3 of FIG. 3, with the enthalpy H on the x axis and the temperature T on the y axis. In this case there is a true exchange between fluids which flow in counter-current. The cold end of the exchanger corresponds to the appearance of the first bubble in the liquid without recirculation—in the example selected: at −162° C. As illustrated, the curve for condensation of gas at the top and the curve for evaporation of liquid descending in the second column are almost parallel and therefore the ΔT remains reasonable, with the temperatures of the liquid descending in the second column, which evaporates, ranging between −162° C. at the cold end and −155° C. at the hot end. Furthermore, with a temperature difference which can be reduced by virtue of the film evaporator (~1° C. or even lower), the condensation temperature at the cold end in this example may reduce to −161° C.

More generally, the liquid descending in the second column K2 arrives in the exchanger E3 at a temperature T1 and emerges therefrom at a temperature T2, with T2>T1+2° C., preferably T2>T1+3° C.

More generally, the gas ascending from the first column K1 arrives in the heat exchanger E3 at a temperature T3 and emerges therefrom at a temperature T4, with T3>T4+2° C., preferably T3>T4+3° C., more generally T4−T1<1.5° C.

FIG. 3 shows that:

The nitrogen-enriched gas NG for condensation, from the top of the first column K1, is introduced at the bottom of a first series of passages of the exchanger E3 through two conduits 5.

The nitrogen-enriched gas NG for condensation from the top of the first column K1 is not introduced into the second series of passages of the exchanger E3.

The uncondensed, nitrogen-enriched gas NG' is collected at the top of the passages of the first series (optionally with a zero flow rate in normal operation or extraction of a small flow rate of non-condensables).

The liquid NL resulting from the condensation of the nitrogen-enriched gas is collected at the bottom of the first series of passages of E3.

The liquid L for evaporation is distributed at the top of the second series of passages of the exchanger E3, falling directly from the lowest heat and mass exchange section of the second column K2.

The liquid for evaporation falling directly from the lowest heat and mass exchange section of the second column K2 is not sent to the first series of passages.

A biphasic fluid L+V obtained from the partial evaporation of liquid L is collected at the bottom of the second series of passages. It is then sent partly as liquid 11 to the second column K2 and partly via the conduits 5 to the top of the first column K1 as reflux.

In the example, the biphasic fluid exits in the bottom of the column K2, which then serves as a phase separator, with the gas of the biphasic fluid ascending in the heat and mass exchange section, and the liquid accumulating in the bottom of the column K2.

The exchanger E3 may also be located within a chamber arranged in the second column, with the bottom of the chamber serving to collect the biphasic mixture. In this case, the chamber is used as a phase separator for the biphasic fluid.

The exchanger E3 may be located inside a chamber arranged below the second column, with the bottom of the chamber serving to collect the biphasic mixture. In this case, the chamber serves as a phase separator for the biphasic fluid, and the gas formed is returned to the column K2; the liquid may be withdrawn as product 15.

Alternatively a reservoir R may be provided at the bottom of the column K2.

The mixture 1 comprises nitrogen and methane, preferably as the main components. The percentage of nitrogen in the mixture differs from the percentage of methane in the mixture preferably by at most 20%, or even at most 10%. For example, the mixture may contain 30% of nitrogen and 50% of methane (a difference of 20%) or 45% of nitrogen and 50% of methane (a difference of 5%).

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for separating a mixture containing at least nitrogen and methane by cryogenic distillation in a system of columns comprising a first column operating in a first pressure and a second column operating at a second pressure lower than the first pressure, the mixture being separated in the first column to form a first gas rich in nitrogen and a first liquid rich in methane, at least a portion of the first gas rich in nitrogen being at least partially condensed in a heat exchanger and returned to the first column, the liquid enriched in nitrogen being sent from the exchanger or from the first column to the second column, a second liquid rich in methane being withdrawn at the bottom of the second column and a second gas rich in nitrogen being withdrawn at the top of the second column, the heat exchanger comprising a stack of plates and fins, the plates being disposed with their axis vertically and the space between the plates forming vertical passages, wherein the first gas enriched in nitrogen is sent into the heat exchanger by the bottom, ascends in a first series of passages of the exchanger and condenses therein at least partially, the liquid formed descending in these passages of the first series and exiting via the bottom of the exchanger, the liquid descending in the second column being distributed to descend in another series of passages of the exchanger, therein evaporating partially to form a biphasic mixture which is collected at the bottom of the exchanger, wherein no portion of the first liquid rich in methane is sent from the first column to the second column.

2. The method according to claim 1, wherein non-condensable gases are extracted at least periodically from the first series of passages.

3. The method according to claim 1, wherein the condensed first gas rich in nitrogen is sent to the top of the first column.

4. The method according to claim 3, wherein the condensed first gas rich in nitrogen is sent to the top of the first column via two or more conduits connecting the exchanger to the top of the first column.

5. The method according to claim 1, wherein the liquid descending in the second column arrives in the exchanger at between −160° C. and −164° C.

6. The method according to claim 1, wherein the liquid descending in the second column arrives in the exchanger at a temperature T1 and emerges therefrom at a temperature T2, with T2>T1+2° C.

7. The method according to claim 1, wherein the liquid descending in the second column exits from the other series of passages, therein evaporating partially at between −153° C. and −157° C.

8. The method according to claim 1, wherein the gas ascending from the first column arrives in the exchanger at a temperature T3 and emerges therefrom at a temperature T4, with T3>T4+2° C.

9. The method according to claim 6, wherein T4-T1<1.5° C.

10. The method according to claim 1, wherein the gas ascending from the first column to the first series of passages of the exchanger exchanges material with the liquid formed descending in these passages.

11. The method according to claim 10, wherein a distillation step is carried out in the passages of the first series.

12. The method according to claim 1, wherein the percentage of nitrogen in the mixture differs from the percentage of methane in the mixture by at most 20%.

* * * * *